United States Patent [19]

Oshida

[11] Patent Number: 5,004,306

[45] Date of Patent: Apr. 2, 1991

[54] DRAWER DEVICE

[75] Inventor: Tsutomu Oshida, Yokohama, Japan

[73] Assignee: Nifco, Inc., Yokohama, Japan

[21] Appl. No.: 450,482

[22] Filed: Dec. 14, 1989

[30] Foreign Application Priority Data

Dec. 14, 1988 [JP] Japan ..... 63-162024[U]

[51] Int. Cl.[5] ..... A47B 88/00

[52] U.S. Cl. ..... 312/319; 312/333

[58] Field of Search ..... 312/333, 319, 336, 337, 312/341.1

[56] References Cited

U.S. PATENT DOCUMENTS

| | | | |
|---|---|---|---|
| 1,111,026 | 9/1914 | Kroos | 312/341 |
| 2,780,510 | 2/1957 | Cole | 312/341.1 |
| 3,109,688 | 11/1953 | Middleton | 312/341.1 |
| 3,592,521 | 7/1971 | Cox | 312/333 |
| 4,494,806 | 1/1985 | Williams et al. | 312/333 |

FOREIGN PATENT DOCUMENTS

| | | |
|---|---|---|
| 6138476 | 5/1958 | Japan . |
| 6211480 | 12/1982 | Japan . |

*Primary Examiner*—Joseph Falk

*Attorney, Agent, or Firm*—Schwartz & Weinrieb

[57] ABSTRACT

A drawer device includes a staionary case, a guide piece provided within the stationary case and rotatably supporting a plurality of balls along opposite side wall portions thereof in a sliding direction, a slide piece disposed within the guide piece and in contact with the balls, a movable case having a bottom surface to which the slide piece is fixed, and a spring provided between the stationary case and the movable case. When the movable case is accommodated within the stationary case, and latched at such state by means of a latching device defined between the movable case and the stationary case, the spring is tensioned so as to tend to bias the movable case in an ejection direction.

15 Claims, 3 Drawing Sheets

DRAWER DEVICE

FIELD OF THE INVENTION

This invention relates to a drawer device and, more particularly, to a drawer device which can exhibit an automatic ejection operation with low frictional torque.

DESCRIPTION OF THE PRIOR ART

System for achieving the automatic ejection of an ashtray, a holder table, and other such case-like members, are nowadays extensively employed within ashtrays and cup holders mounted within vehicles. In connection with the usual structure for achieving automatic ejection of a case, a movable case is spring biased in the outward direction and can be automatically locked and unlocked when the same is accommodated within a stationary case such that it is automatically ejected by means of the spring force when it is unlocked.

However, since the stationary and movable cases are made of plastic or similar materials, great frictional torque is produced if the two members are in close contact engagement with each other. Therefore, a spring member having a comparatively high spring constant has to be employed for ensuring reliable automatic ejection. This means that with an increase in the size of the drawer device of this type, the spring size has to be increased and thus occupies a large space within the drawer device and hence reduces the space for accomodating articles.

Moreover, increasing the spring size results in considerable variation in the ejection operation. Although this is not particularly significant in the case of a small sized, light weight drawer device, significant problems arise in the case of a drawer device, which ejects a large sized, heavy weight unit such as for example, a CD player or a cassette player.

OBJECT OF THE INVENTION

The present invention seeks to solve the above problems, and its object is to provide a drawer device, which is operable with a low amount of resistance and thus permits a size reduction of the spring for the ejection operation.

SUMMARY OF THE INVENTION

To attain the above object of the invention, there is provided a drawer device, which comprises a stationary case open at the top and front ends thereof, a guide piece provided within the stationary case and rotatably supporting a plurality of balls arranged along opposite side wall portions in reciprocating sliding direction, a slide piece engaged within the guide piece and in contact with the balls, a movable case connected to the slide piece, a spring for biasing the movable case in an ejection direction, latch means for latching the movable case within the stationary case an accommodated state when the movable case in disposed at and releasing means for releasing the latch means from the latched state so as to permit ejection of the movable case from the stationary case.

With the drawer device according to the invention as noted above, the movable case is moved along the stationary case by means of the plurality of balls. Thus, frictional torque during sliding of the movable case is greatly reduced, and sufficient ejection force can be imparted to the movable case with a small sized spring even if the size of the movable case is increased.

BRIEF DESCRIPTION OF THE DRAWINGS

The above and other features and objects of the invention will become apparent from the following detailed description when is made reference to the attached drawings in which like reference characters designate like or corresponding parts throughout the several views, and wherein:

FIG. 2(*b*) is a sectional view showing the drawer device of FIG. 1 with the movable case in an ejected state;

DETAILED DESCRIPTION OF THE PREFERRED EMBODIMENTS

Figure 1:
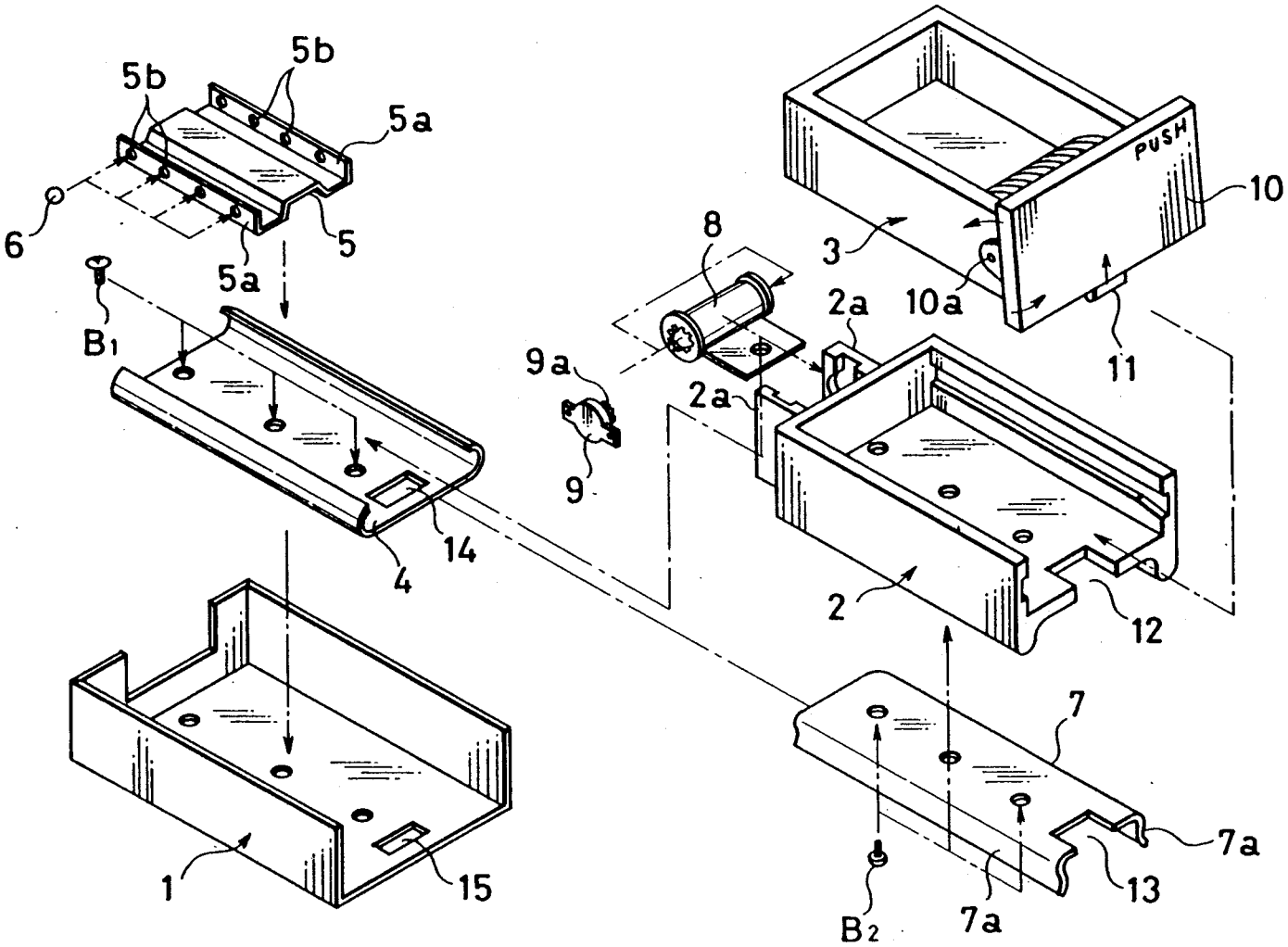
FIG. 1 is an exploded perspective view showing a first embodiment of the drawer device constructed according to the present invention.

FIG. 1 shows a first embodiment of the drawer device constructed according to the present invention as applied to an ashtray mounted within a vehicle.

Figure 2:
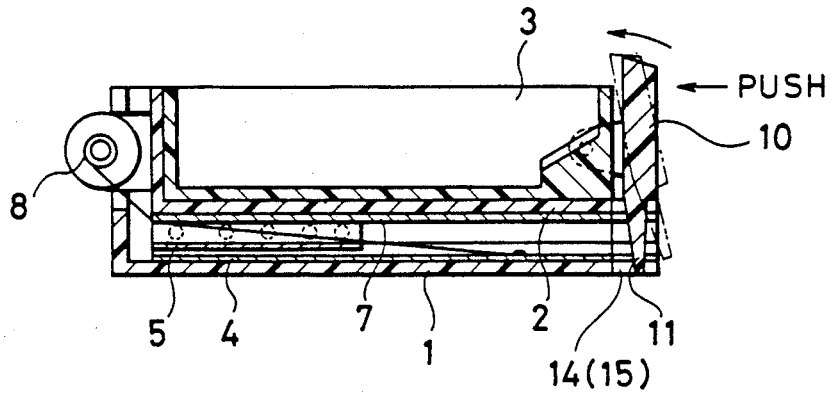
FIG. 2(*a*) is a sectional view showing the drawer device of FIG. 1 with a movable case in an accommodated state.
Figure 2:
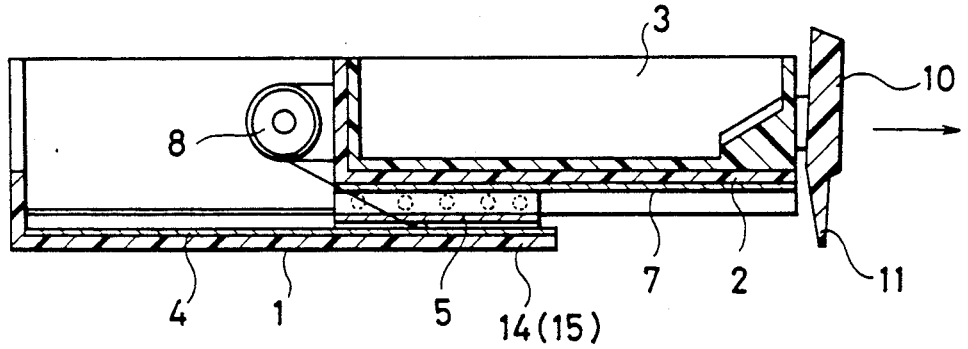
Figure 3:
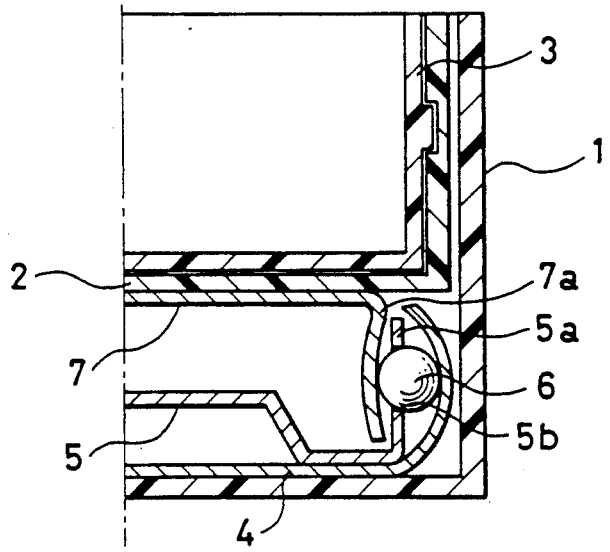
FIG. 3 is a fragmentary transverse sectional view, on an enlarged scale, showing the ball bearing system of the drawer device of FIG. 1.

Referring to FIGS. 1 to 3, reference numeral 1 designates a stationary case of a plastic material fixedly secured to an instrument panel or the like of a vehicle, 2 is a movable case made from a plastic material and accommodated within the stationary case 1 and capable of being automatically ejected from the same, and 3 is an ashtray body made from an incombustible plastic material accommodated and within the movable case 2 and capable of being manually removed from the movable case 2.

The stationary case 1 is open at the top and front ends thereof. A guide piece 4, which is a press molding made from a suitable metal, is secured by means of a plurality of bolts B1 to the bottom inner surface of the stationary case 1. The guide piece 4 has a sectional profile comprising a lip groove, and a ball retainer piece 5 is slidingly disposed in an engaged state within the guide piece 4. Each side wall portion 5*a* of the ball retainer piece 5 has a plurality of ball support holes 5*b*, balls 6 are each rotatably held between each ball support hole 5*b* and an associated side wall portion of the guide piece 4 such that the balls project partically inwardly from each ball support hole 5*b* toward a slide piece 7.

The slide piece 7, which is a press molding made from a suitable metal, is secured by means of bolts B2 to the bottom outer surface of the movable case 2. The slide piece 7 is disposed within the ball retainer piece 5 with its opposite side wall portions 7*a* in slidable contact with the individual balls 6.

The movable case 2 has a rearwardly projecting integral bracket 2*a*. Within the bracket 2*a*, opposite ends of a retractor type spring 8 are rotatably supported, and one end of the spring 8 is enmeshed with a rotary gear 9*a* of an oil damper 9 secured to the bracket 2*a*.

An end portion of the spring 8 is secured to the guide means of piece 4 by a bolt B1 inserted through holes formed within these two parts.

The front of the ashtray body 3 is provided with a lid 10, which is pivotally coupled by means of pins 10*a* to the ashtray body 3 and is held upright by means of a torsion spring (not shown) or the like. The lid 10 has an integral latch pawl 11 projecting from a central portion of its lower end. The latch pawl 11 extends through notches 12 and 13 formed within end portions of the movable case 2 and slide piece 7 and can be engaged within and disengaged from latch holes 14 and 15 formed within end portions of the guide piece 4 and stationary case 1.

With the above construction, with the movable case 2 accommodated within the stationary case 1 as shown in FIG. 2(*a*), the spring 8 is fully elongated, and the latch pawl 11 of the lid 10 is engaged within the latch holes 14 and 15 of guide piece 4 and case 1 so as to maintain the movable case 2 together with the ashtray body 3 at their inserted position with respect to stationary case 1.

When an upper portion of the lid 10 is pushed inwardly from this state, the latch pawl 11 is disengaged from the latch holes 14 and 15, causing the movable case 2 to be ejected from the stationary case 1 under the influence of the biasing force of the spring 8 in the winding direction, as shown in FIG. 2(*b*).

At this time, the spring 8 is taken up at a relatively slow rate due to the damping action of the oil damper 9. The movable case 2 is thus slowly ejected so as to expose the tray surface of the ashtray body 3.

In addition, the movable case 2 and stationary case 1 are not in direct contact with each other, but the opposite side wall portions 7*a* of the slide piece 7 are moved in point contact with the balls 6, as shown in FIG. 3. Therefore, frictional resistance at the time of the sliding is greatly reduced compared to the conventional impact accompanying planar contact of plastic members with each other. This means that the spring 8 need not provide a large biasing force, and thus it may be small in size.

As the oil damper 9, there may be used a one-way damper providing a braking action in only one direction as disclosed in the U.S. Pat. No. 4,697,673, whereby there is no possibility of causing loss of the spring force.

In order to accommodate the movable case 2 within the stationary case 1 from the ejected state, the lid 10 is pushed inwardly. With the lid 10 pushed inwardly, the movable case 2 is accommodated within the stationary case 1 against the biasing force of the spring 8. In the final stage of accommodation, the latch pawl 11 rides over the front edge of the guide piece 4 so as to cause inclination of the lid, and when it comes into alignment with the position of the latch holes 14 and 15, it is the latch holes by means of the spring force tending to move the lid to its vertical position. Thus, the movable case 2 is again maintained at the accommodated state as shown in FIG. 2(*a*).

Figure 4:
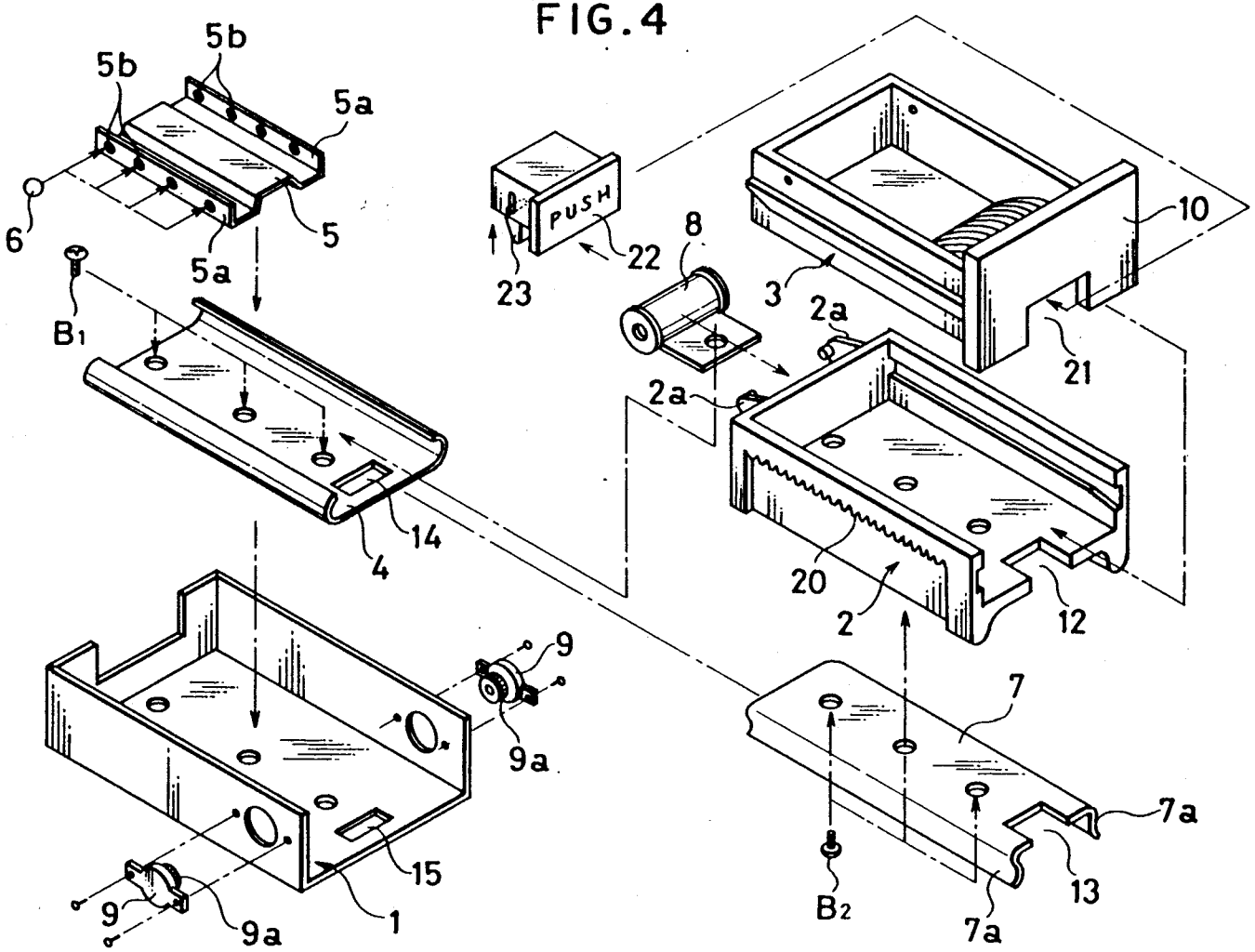
FIG. 4 is an exploded perspective view showing a second embodiment of the drawer device constructed according to the present invention.

FIG. 4 shows a second embodiment of the drawer device constructed according to the present invention and as again applied to an ashtray. Parts like those in the first embodiment are designated by means of like reference numerals.

Referring to FIG. 4, an oil damper 9 is provided upon each side wall portion of a stationary case 1, with its rotary gear 9*a* projecting inwardly therefrom.

Each side wall portion of a movable case 2, on the other hand, is provided with a rack 20 which is meshed with each rotary gear 9*a*, thus providing a damper action when the movable case is ejected as in the previous embodiment.

A lid 10 has a notch 21 formed within its lower end and a push piece 22 has a latch pawl 23 releasably engageable within the notch 21.

The vertically movable latch pawl 23 projects from the bottom of the push piece 22. When the push piece 22 is therefore pushed as shown by means of arrow, the latch pawl 23 is raised and released from latch holes 14 and 15.

In this embodiment, as in the previous embodiment, the movable case 2 is moved along the stationary case 1 with the lower regions of the opposite side wall portions 7*a* of the slide piece 7 disposed in point contact with balls 6. Thus, frictional resistance can be greatly reduced, and the device can be effectively operated by using a spring which is small in size and does not need to provide a large beasing force.

While the above embodiments of the invention are concerned with ashtrays mounted within a vehicle, the drawer device according to the invention is applicable as well to an ashtray combined with a cigarette lighter or a coin holder and also to comparatively large sized apparatus such, as for example a CD player or a cassette player mounted within a vehicle. Furthermore, the invention is of course applicable to apparatus and devices which are not mounted within a vehicle.

As has been described in the foregoing, with the drawer device according to the invention the slide piece provided within the device can be moved as a result of point contact with the balls upon the stationary guide piece. Thus, frictional resistance during sliding can be dramatically reduced, and the spring force required for ejecting even a movable case of large size can be provided by means of a spring which is small in size and light in weight.

Thus, since according to the invention even a comparatively heavy movable case can be sufficiently operated by means of a comparatively small spring, the space occupied by means of the spring can be reduced so as to permit a compact construction of the apparatus.

Obviously, many modifications and variations of the present invention are possible in light of the above teachings. It is therefore to be understood that within the scope of the appended claims, the present invention may be practiced otherwise than as specifically described herein.

What is claimed is:

1. A drawer device, comprising:

a stationary case open at the top and front ends thereof;

a guide piece disposed within said stationary case and rotatably supporting a plurality of balls arranged along opposite side wall portions thereof in a reciprocating sliding direction;

a slide piece disposed within said guide piece and in contact with said balls;

a movable case fixed to said slide piece;

a front cover mounted upon said movable case;

a spring interposed between said movable case and said stationary case for biasing said movable case in an ejection direction out of said stationary case; and latch means for latching said front cover of said movable case to a recess defined within a front portion of said stationary case for releasably latching said movable case within said stationary case in an accommodated state and for releasing said movable case from said latched state so as to permit said movable case to be ejected from said stationary case under the influence of the biasing force of said spring.

2. A device as set forth in claim 1, further comprising:

fastening means for fixedly securing said guide piece to said stationary case.

3. A device as set forth in claim 1, further comprising:

fastening means for fixedly securing said slide piece to said movable case.

4. A device as set forth in claim 1, further comprising:

a ball retainer, having a plurality of holes defined within opposite sidewall portions thereof for rotatably housing said plurality of balls, interposed between said slide piece and and guide piece.

5. A device as set forth in claim 4, wherein:

said guide piece has a substantially U-shaped configuration in cross-section and includes opposite upstanding sidewalls serving as outer race means for engaging said plurality of balls; and said slide piece has a substantially U-shaped configuration in cross-section and includes opposite dependent sidewalls serving as inner race means for engaging said plurality of balls.

6. A device as set forth in claim 1, further comprising:

bracket means fixedly secured upon said movable case for mounting one end of said spring, an opposite end of said spring being fixed to said stationary case.

7. A device as set forth in claim 6, wherein:

said spring comprises a retractor-type coiled spring.

8. A device as set forth in claim 7, further comprising:

damping means mounted upon said bracket means and operatively engaged with said one end of said spring for damping said movement of said movable case from said latched state to an ejected state in said ejection direction under the influence of said biasing force of said spring.

9. A device as set forth in claim 8, wherein:

said damping means comprises a one-way oil type damper.

10. A device as set forth in claim 1, further comprising:

receptacle means removably disposed within said movable case.

11. A device as set forth in claim 10, wherein:

said receptacle means comprises an ashtray.

12. A device as set forth in claim 10, wherein:

said latch means and said front cover are disposed upon said receptacle.

13. A device as set forth in claim 1, further comprising:

damping means mounted upon said stationary case and operatively engaged with said movable case for damping said movement of said movable case from said latched state to an ejected state in said ejection direction under the influence of said biasing force of said spring.

14. A device as set forth in claim 13, wherein:

said damping means comprises rotary gears; and said movable case comprises rack means for engaging said rotary gears of said damping means.

15. A device as set forth in claim 14, wherein:

said damping means comprises a pair of rotary gears mounted upon opposite sides of said stationary case; and said rack means comprises a pair of racks integrally formed within opposite sidewalls of said movable case.

* * * * *